US011898574B2

(12) United States Patent
Sinico et al.

(10) Patent No.: US 11,898,574 B2
(45) Date of Patent: Feb. 13, 2024

(54) PUMP HAVING AN ELECTRIC MOTOR CONTAINED IN A SHELL ENCLOSED BY A MONOLITHICALLY PROVIDED CONTAINMENT JACKET

(71) Applicant: DAB PUMPS S.P.A., Mestrino (IT)

(72) Inventors: Francesco Sinico, Montecchio Maggiore (IT); Pietro Cailotto, Trissino (IT); Michele Cappocchin, Mestrino (IT); Mattia Casagrande, Vicenza (IT); Luca Calore, Creazzo (IT)

(73) Assignee: DAB PUMPS S.P.A., Mestrino (IT)

( * ) Notice: Subject to any disclaimer, the term of this patent is extended or adjusted under 35 U.S.C. 154(b) by 294 days.

(21) Appl. No.: 17/195,812

(22) Filed: Mar. 9, 2021

(65) Prior Publication Data

US 2021/0277912 A1 Sep. 9, 2021

(30) Foreign Application Priority Data

Mar. 9, 2020 (IT) ..... 102020000004882

(51) Int. Cl.

| | |
|---|---|
| ***F04D 29/40*** | (2006.01) |
| ***F04D 13/06*** | (2006.01) |
| ***F04D 13/16*** | (2006.01) |
| ***F04D 29/00*** | (2006.01) |
| ***F04D 29/043*** | (2006.01) |

(Continued)

(52) U.S. Cl.

CPC ..... *F04D 29/406* (2013.01); *F04D 13/06* (2013.01); *F04D 13/16* (2013.01); *F04D 29/007* (2013.01); *F04D 29/043* (2013.01); *F04D 29/605* (2013.01); *F04D 1/06* (2013.01);

(Continued)

(58) Field of Classification Search

CPC ..... F04D 29/007

See application file for complete search history.

(56) References Cited

U.S. PATENT DOCUMENTS 2,470,563 A * 5/1949 Jennings ..... F04D 29/606 417/370
3,764,236 A * 10/1973 Carter ..... F04D 29/049 417/372

(Continued)

FOREIGN PATENT DOCUMENTS

JP H08-159080 A 6/1996
JP H08159080 * 6/1996 ..... F04D 15/00
WO 2019/123504 A1 6/2019

OTHER PUBLICATIONS

JPH08159080Machine Translation, Mar. 15, 2023. (Year: 1996).*

(Continued)

*Primary Examiner* — Nathan C Zollinger
*Assistant Examiner* — Timothy P Solak
(74) *Attorney, Agent, or Firm* — Scully, Scott, Murphy & Presser, P.C.

(57) ABSTRACT

An electric pump for moving a liquid having an electric motor contained in a shell enclosed by a monolithically provided containment jacket. The pump includes a mechanical section having an assembly for moving liquid via impellers and diffusers, an electromechanical section, which includes an electric motor in a shell that includes a rotor and a stator and first and second covers at the ends of the containment jacket having an intake port and a delivery port which are fluidically connected to the mechanical section.

17 Claims, 8 Drawing Sheets

(51) Int. Cl.

| | |
|---|---|
| ***F04D 29/60*** | (2006.01) |
| *F04D 1/06* | (2006.01) |
| *F04D 29/42* | (2006.01) |
| *F04D 29/08* | (2006.01) |
| *F04D 29/58* | (2006.01) |
| *F04D 29/44* | (2006.01) |

(52) U.S. Cl.
CPC ..... *F04D 29/086* (2013.01); *F04D 29/426* (2013.01); *F04D 29/445* (2013.01); *F04D 29/5813* (2013.01)

(56) References Cited

U.S. PATENT DOCUMENTS 4,909,705 A * 3/1990 Katsura ..... F04D 1/063 415/214.1
5,601,419 A * 2/1997 Kobayashi ..... F04D 29/628 415/213.1
5,888,053 A * 3/1999 Kobayashi ..... F04D 29/4266 417/244
6,200,108 B1 3/2001 Caudill et al.
7,442,014 B1 * 10/2008 Mellinger ..... F04D 13/0686 417/18
2005/0047933 A1 3/2005 Ottoboni
2009/0246039 A1 * 10/2009 Haack ..... F04D 13/024 417/244
2014/0093409 A1 * 4/2014 Tazioli ..... F04D 1/066 417/423.11
2014/0241921 A1 * 8/2014 Tazioli ..... F04D 1/006 415/182.1
2017/0218977 A1 8/2017 Sinico et al.
2018/0073509 A1 * 3/2018 Madsen ..... F04D 1/00
2018/0363659 A1 * 12/2018 Mikkelsen ..... F04D 29/628
2019/0024682 A1 1/2019 Walton et al.

OTHER PUBLICATIONS

Italian Search Report and Written Opinion dated Nov. 2, 2020 issued in IT 202000004882 together with a partial English translation.

* cited by examiner

PUMP HAVING AN ELECTRIC MOTOR CONTAINED IN A SHELL ENCLOSED BY A MONOLITHICALLY PROVIDED CONTAINMENT JACKET

The present invention relates to an electric pump with jacket.

Currently, vertical surface electric pumps are known and widespread which comprise an external containment jacket which encloses:

a mechanical section, which comprises an intake port and a delivery port, to which the intake and delivery ducts are connected, and contains one or more impellers, interleaved by diffusers keyed on a driving shaft adapted to rotate them, for the movement of the liquid, an electromechanical section, comprising an electronic board for controlling the electric pump and an electric motor, contained in a shell and comprising in turn a rotor keyed on the driving shaft and a stator which surrounds said rotor.

In the present description, the expression "vertical electric pump" means an electric pump that has a vertical configuration for use and a vertical axis of extension, with the mechanical section in its lower part and the electromechanical section in its upper part, above the mechanical section.

Normally, the external jacket is made of metallic material and/or plastic material and has a substantially tubular shape, with a cylindrical extension.

This background art has some drawbacks.

The external jacket is often provided by means of at least two complementary parts, to be connected during the assembly of the electric pump:

a first part, adapted to contain substantially the mechanical section, a second part, which lies above the first one in the configuration for use of the electric pump and is adapted to contain substantially the electromechanical section.

The presence of two parts causes a long and cumbersome assembly process and the need to fix these two parts to one another and to an upper cover and to the pump body, usually at the interface between the mechanical section and the electromechanical section.

Moreover, a jacket in two parts also causes a production process of the jacket which is long, cumbersome and constituted by multiple successive steps.

Furthermore, in vertical electric pumps of the known type the electronic board can be connected to the electric motor:

directly, by means of connectors, and therefore arranged adjacent to the motor, indirectly, by means of cables.

In both cases, the board is contained in an assembly which must be close to the electromechanical section and in contact with a surface inside which the pumping liquid flows for its cooling.

This leads to considerable and complex space occupations of the electric pump.

Finally, in vertical electric pumps of the known type the external jacket:

does not allow the drainage of any liquid that may have seeped through the mechanical seal, located at the interface between the mechanical section and the electromechanical section or allows the drainage of such liquid, but the installation technician/user is unable to detect any tightness problems of the electric pump, except by direct visual contact with the section from which the liquid is seeping.

The aim of the present invention is to provide an electric pump that is capable of improving the background art in one or more of the aspects mentioned above.

Within this aim, an object of the invention is to provide an electric pump with an external containment jacket that has a production process of the jacket and of the entire electric pump that is easier and quicker than similar electric pumps of the known type.

Another object of the invention is to provide an electric pump that has a jacket which allows the fixing of the electronic board so as to reduce the overall space occupations of the electric pump with respect to similar electric pumps of the known type.

Another object of the invention is to provide an electric pump that allows the draining of any liquid that has seeped through the mechanical seal, at the interface between the mechanical section and the electromechanical section, and allows the installation technician/user to become aware of the tightness problem without direct visual contact with the affected section.

A further object of the present invention is to overcome the drawbacks of the background art in a manner that is alternative to any existing solutions.

Another object of the invention is to provide an electric pump that is highly reliable, relatively easy to provide and at competitive costs.

This aim and these and other objects which will become better apparent hereinafter are achieved by a vertical surface electric pump, for the movement of a liquid, which comprises a containment jacket which encloses:

a mechanical section, which comprises an assembly for moving said liquid which comprises one or more impellers, interleavedby diffusers, keyed on a driving shaft, an electromechanical section, comprising an electric motor, contained in a shell and comprising in turn a rotor and a stator that surrounds said rotor, said rotor being keyed on said driving shaft, said electric pump comprising, at the ends of said jacket, a first cover and a second cover, said second cover having an intake port and a delivery port which are fluidically connected to said mechanical section, said electric pump being characterized in that said jacket is provided monolithically.

Further characteristics and advantages of the invention will become better apparent from the description of preferred but not exclusive embodiments of the electric pump according to the invention, illustrated by way of non-limiting example in the accompanying drawings, wherein:

Figure 1A:
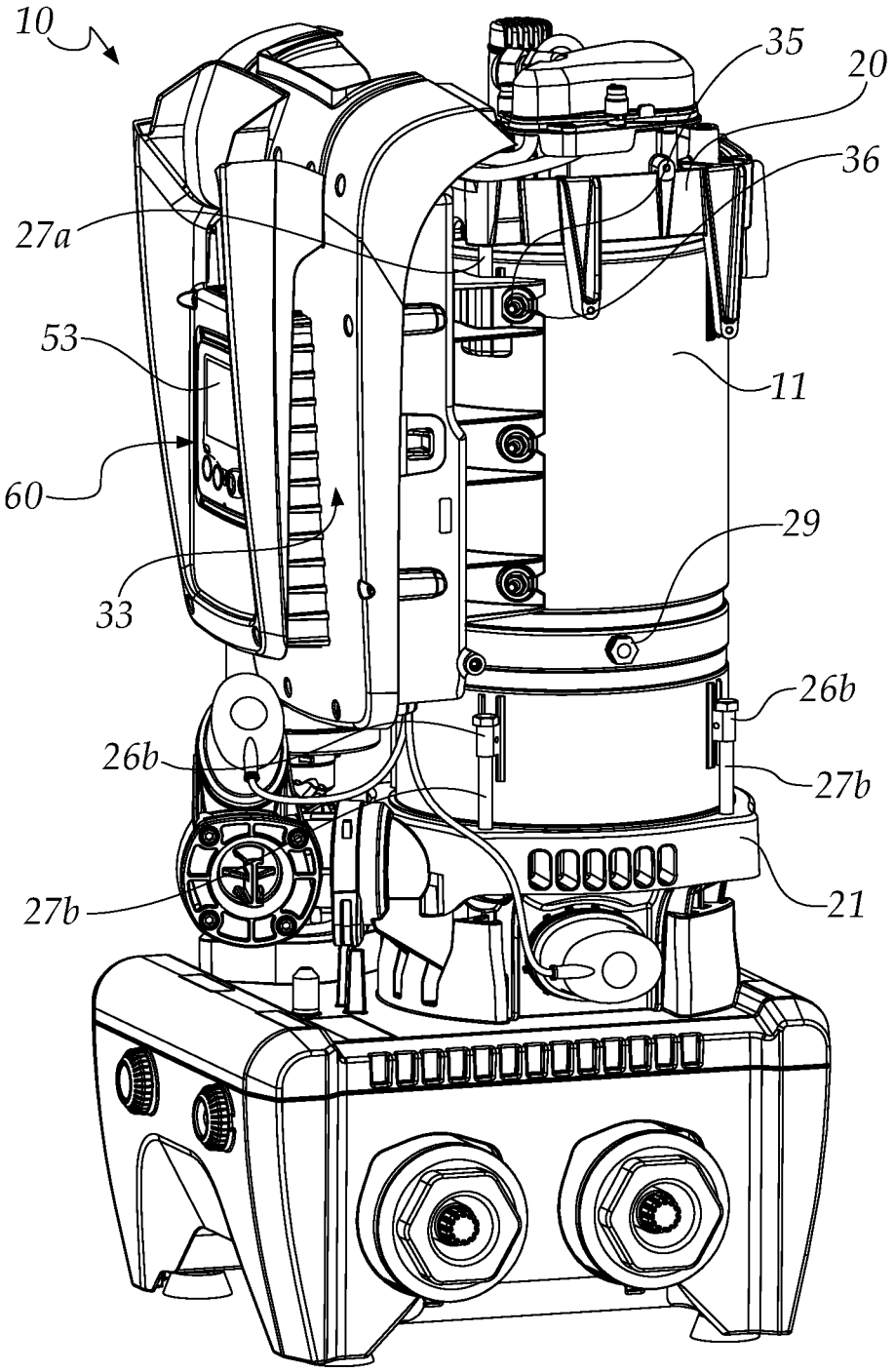
FIGS. 1*a* and 1*b* are each a different general perspective view of an electric pump according to the invention.

With reference to the figures, an electric pump according to the invention is generally designated by the reference numeral 10 in a first embodiment thereof.

Figure 1B:
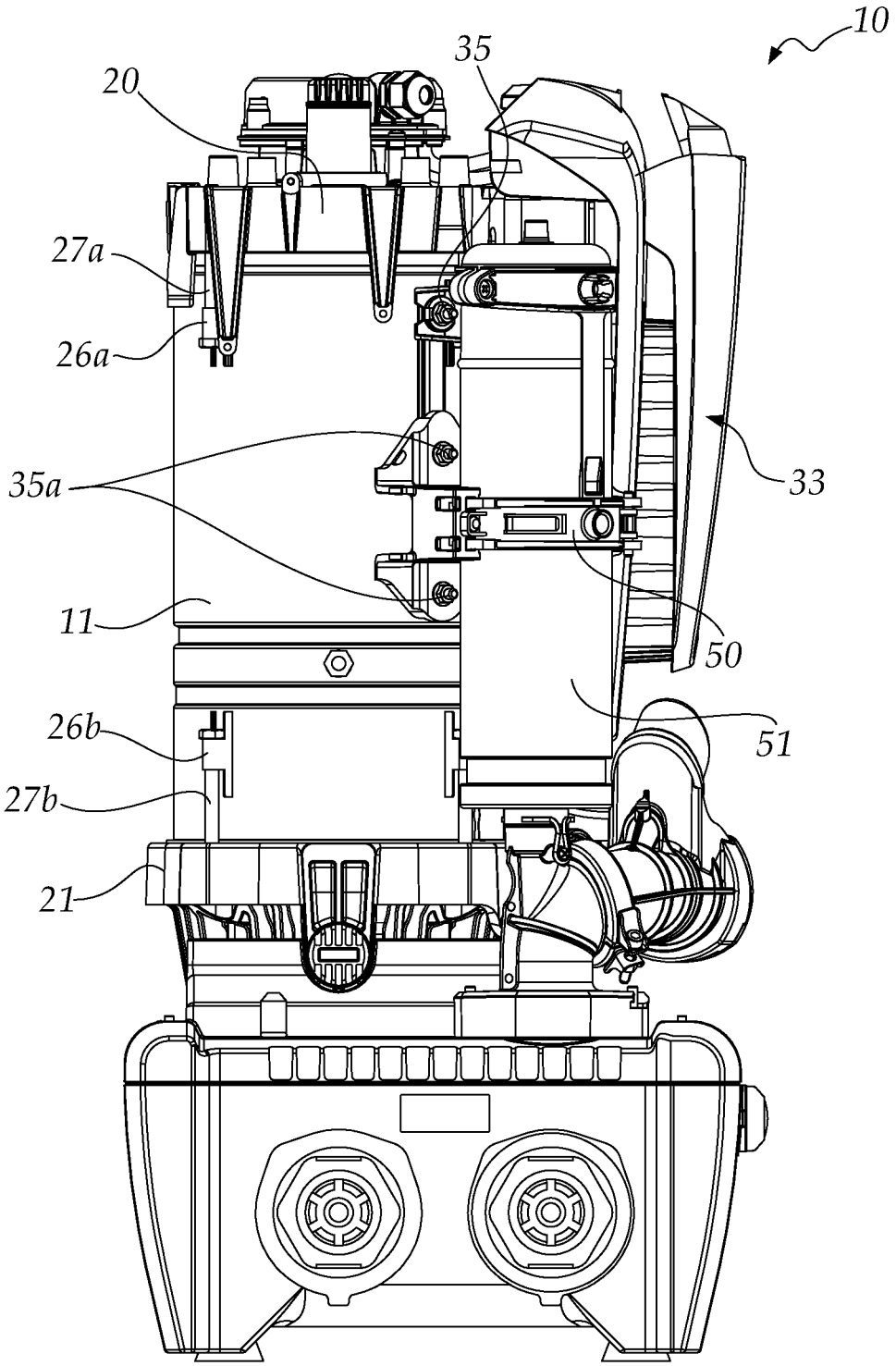

The electric pump 10 shown in FIG. 1 is a vertical surface electric pump.

The electric pump 10 comprises an external containment jacket 11 which encloses, along the axis of extension X of the electric pump 10:

a mechanical section 12, which comprises an assembly 22 for moving the liquid which comprises one or more impellers 23, interleavedby diffusers 24, keyed on a driving shaft 25, an electromechanical section 15, comprising an electric motor 16, contained in a shell 17 and comprising in turn a rotor 18, which is keyed on the driving shaft 25, and a stator 19 which surrounds the rotor 18.

The jacket 11 is closed, at its ends, by:

a first upper cover 20, a second lower cover 21, having an intake port 13 and a delivery port 14 for the electric pump 10, which are fluidically connected to the mechanical section 12.

In the case, not shown in the figures, in which the electric pump comprises a single impeller the presence of a diffuser is not necessary.

The jacket 11 has a substantially tubular shape with a substantially cylindrical extension and its axis of extension coincides with the axis of extension X of the electric pump 10.

One of the particularities of the invention resides in that the jacket 11 is provided monolithically, using metallic material, by calendering and welding.

The jacket 11 is made of stainless steel.

The monolithic jacket 11 allows:

firstly, easier and quicker production thereof, secondly, easier and quicker assembly of the electric pump 10.

This jacket 11 has a plurality of slots 26*a*, 26*b* in which elements 27*a*, 27*b* for fixing the jacket 11 to the covers, respectively the first cover 20 and the second cover 21, are inserted.

In particular, the slots 26*a*, 26*b:* are provided with a hole the axis of extension of which is substantially parallel to the axis of extension of the jacket 11, are arranged on the outer lateral surface of the jacket 11, fixed thereto by welding, proximate to a respective cover, the first one 20 or the second one 21.

These fixing elements 27*a*, 27*b* are, for example, bolts.

Figure 2:
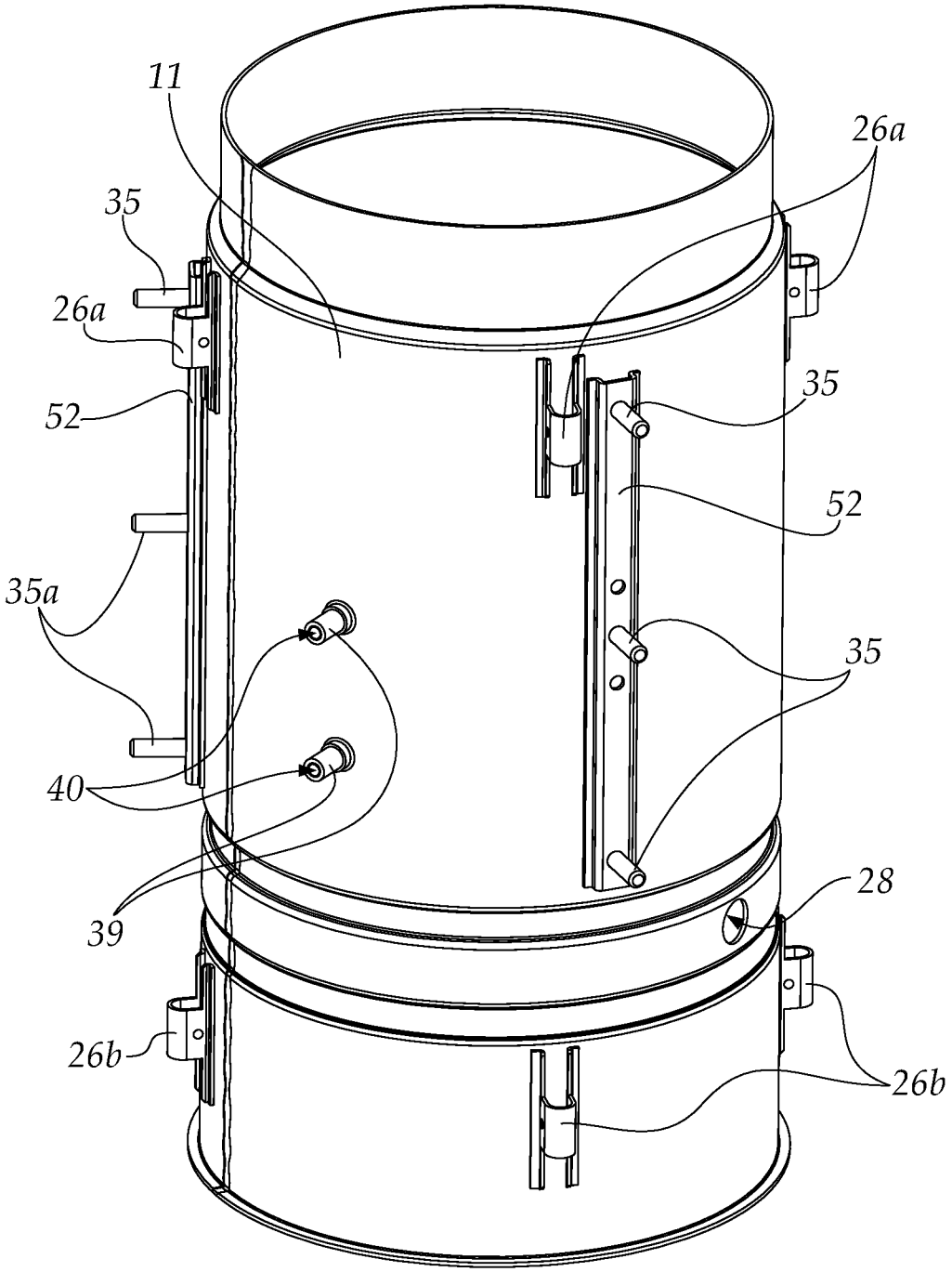
FIG. 2 is a general perspective view of a detail of the electric pump of FIGS. 1*a* and 1*b;*
Figure 4:
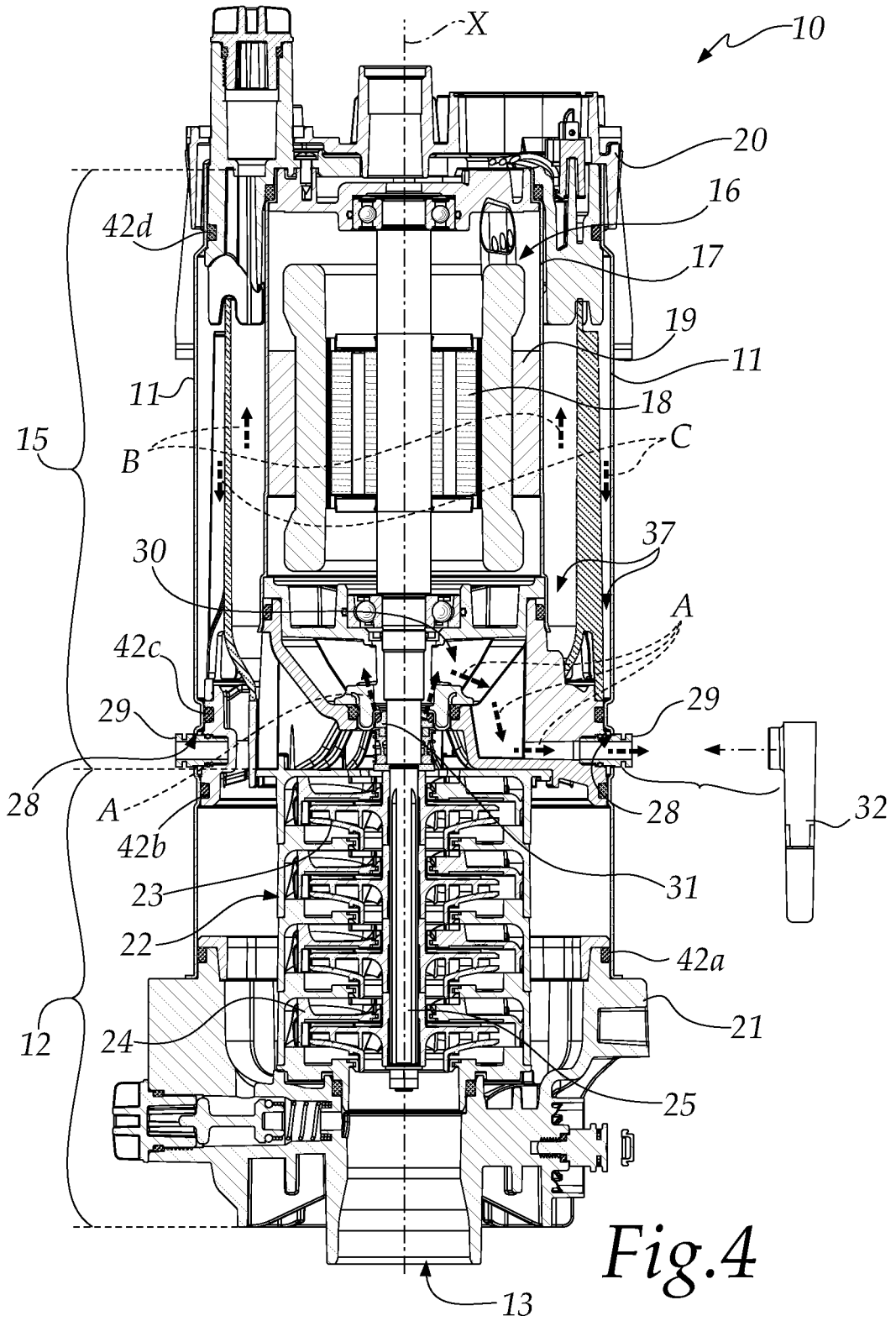
FIG. 4 is a second sectional view of the electric pump of FIGS. 1*a* and 1*b;*

With reference to FIGS. 2 and 4, the jacket 11 has two through holes 28, with an axis of extension that is at right angles to the axis of extension of the jacket 11.

The through holes 28 are at the electromechanical section 15, in a portion 30 thereof, which is proximate to the mechanical section 12 and is substantially comprised between the shell 17 for the containment of the motor 16 and the interface between the mechanical section 12 and the electromechanical section 15.

A nipple 29 is inserted in each through hole 28.

At least one of the nipples 29 is fluidically connected to the portion 30 of the electromechanical section 15.

These nipples 29 facilitate the assembly of the electric pump 10, facilitating the alignment of the jacket 11 with the mechanical section 12 and the electromechanical section 15 and guiding the fixing of the jacket to said sections.

Moreover, the nipples 29 keep the electromechanical section 15 in position inside the jacket 11 during the handling of the unit on the assembly line.

Moreover, the nipple 29 fluidically connected to the portion 30 of the electromechanical section 15 allows the draining, in the direction of the arrows A of FIG. 4, of any liquid that might have seeped through the mechanical seal 31, arranged at the interface between the mechanical section 12 and the electromechanical section 15.

The electric pump 10 can comprise a drainage tray 32 which is connected to the nipple 29 that is connected fluidically to the portion 30 of the electromechanical section 15, in order to collect the liquid that exits from the electric pump 10 through the nipple 29.

Inside the drainage tray 32 there is a sensor, not shown in the figures, which detects the presence of liquid inside it and sends an alarm signal to the electronic board 34 for the control of the electric pump 10.

The signal can be visualized on the display 53 of the pump, allowing the installation technician/user to detect a tightness problem without requiring direct visual contact with the affected section.

The display 53 is contained in the user interface unit 60, which can furthermore have an integrated Wi-Fi module.

In this case, the alarm signal can be sent to the installation technician/user on his mobile phone by means of a dedicated application.

This allows to immediately identify a problem with the mechanical seal and if necessary replace it before it breaks and therefore spills a large amount of liquid toward the motor.

This allows to extend the life of the electric pump 10.

Another particularity of the invention resides in that the electric pump 10 comprises an electronic assembly 33, which contains the electronic board 34 for the control of the electric pump 10 which is fixed to the outer lateral surface of the jacket 11.

In this manner the electronic board 34 is fixed parallel to the axis of extension X of the electric pump 10, reducing the overall space occupations thereof, with respect to similar electric pumps of a known type, ensuring at the same time also the cooling of the board.

In particular, the external lateral surface of the jacket 11 has:

a plurality of elements 35 for fixing it to the electronic assembly 33.

a plurality of elements 35*a* for fixing a collar 50 for the anchoring of a tank 51 of the electric pump 10.

The fixing elements 35, 35*a* are, for example, threaded stems with an axis of extension that is at right angles to the axis of extension of the jacket 11, and are welded and extend from plates 52, which in turn are welded to the outer surface of the jacket 11.

The elements 35 are inserted in corresponding holes, not shown in the figures, of the electronic assembly 33 and are fastened thereto by means of nuts 36.

Such collar 50 is of the snap-acting type and holds in position the tank 51 proximate to the jacket 11, once it has been closed.

The electric pump 10 has a wet portion 37, inside the electromechanical section 15, which is separated from the portion 30 and surrounds the shell 17.

Figure 3:
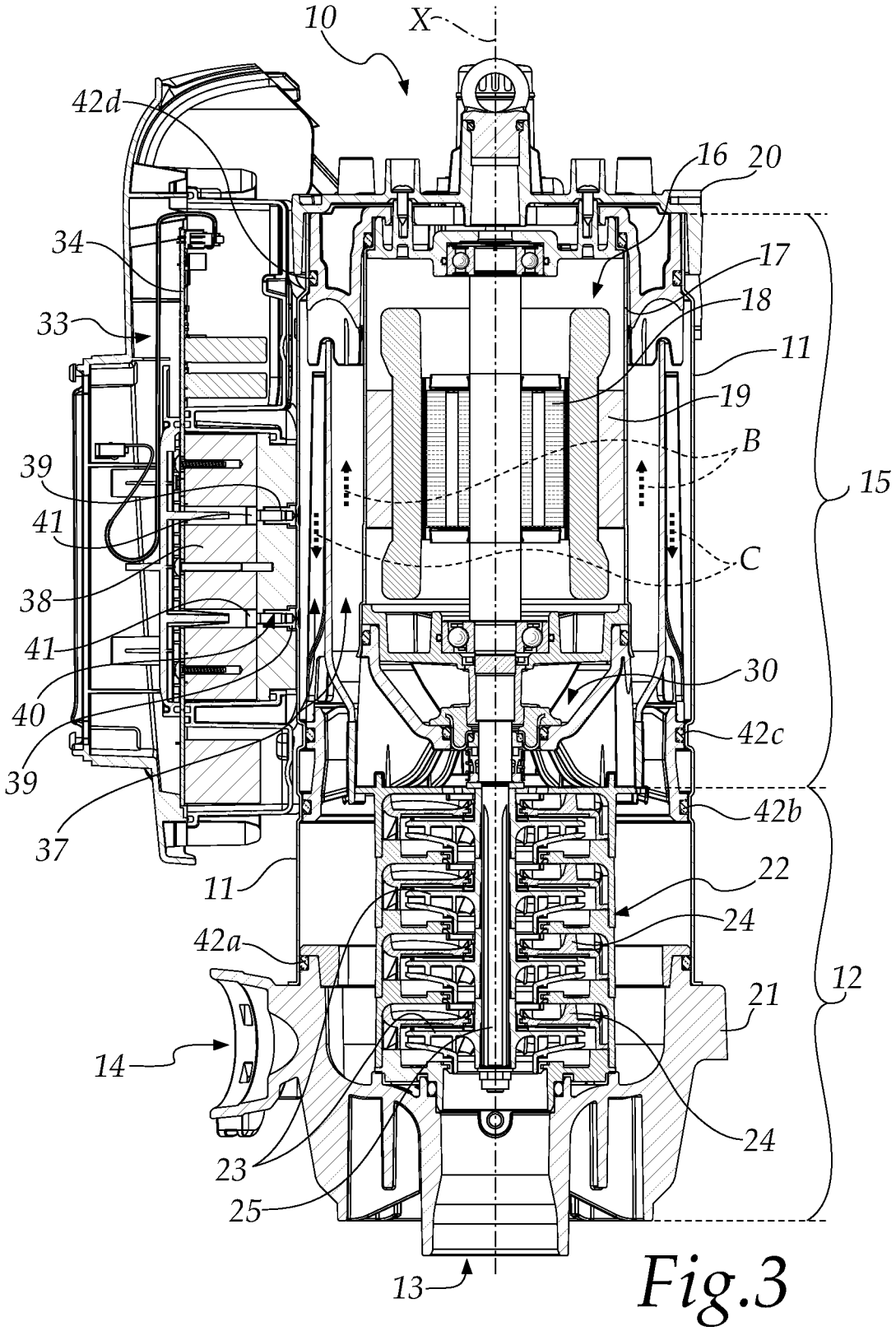
FIG. 3 is a first sectional view of the electric pump of FIGS. 1*a* and 1*b;*

The wet portion 37 is shaped so as to allow the passage of the pumping liquid between the intake port 13 and the delivery port 14, skimming:

the outer lateral surface of the shell 17 of the motor 16, moving from the intake port 13 toward the first cover 20, in the direction of the arrow B in FIGS. 3 and 4, the inner lateral surface of the jacket 11, moving from the first cover 20 toward the delivery port 14, in the direction of the arrow C in FIGS. 3 and 4.

The electronic assembly 33 of the electric pump 10 comprises a heat sink 38 which faces the electronic board 34 on one side and the jacket 11 on the other side.

In this manner, the pumping liquid, by moving from the first cover 20 toward the delivery port 14, in the direction of the arrow C in FIGS. 3 and 4, cools the heat sink 38 which faces the outer surface of the jacket 11.

The jacket 11 has one or more elements 39 for the fixing/support/thermal contact of the electronic assembly 33 to the jacket 11.

The elements 39 for the fixing/support/thermal contact of the electronic assembly 33 to the jacket 11 are, for example, pins with an internal dead hole 40, the axis of extension of which coincides with the axis of extension of the pin and which are welded to the jacket 11 with their axis of extension at right angles to the axis of extension of the jacket 11. The pins 39 are inserted in corresponding through holes of the heat sink 38 and fastened to it by means of respective screws 41, which in turn are inserted in the holes 40 of the pins 39.

Such pins 39 are two in the example shown in the figures.

Another particularity of the invention resides in that the jacket 11 has such a shape as to provide a mechanical seal with a plurality of corresponding sealing elements 42*a*, 42*b*, 42*c*, 42*d*, arranged along the axis of extension X of the electric pump 10 inside the jacket 11 at different cross-sections thereof.

The sealing elements are O-rings, respectively:

a first sealing element 42*a*, which is arranged substantially at the interface region between the second cover 21 and the jacket 11, a second sealing element 42*b* and a third sealing element 42*c*, which are arranged at/proximate to the interface between the mechanical section 12 and the electromechanical section 15, a fourth sealing element 42*d*, which is arranged substantially at the interface portion between the first cover 20 and the jacket 11.

Figure 5A:
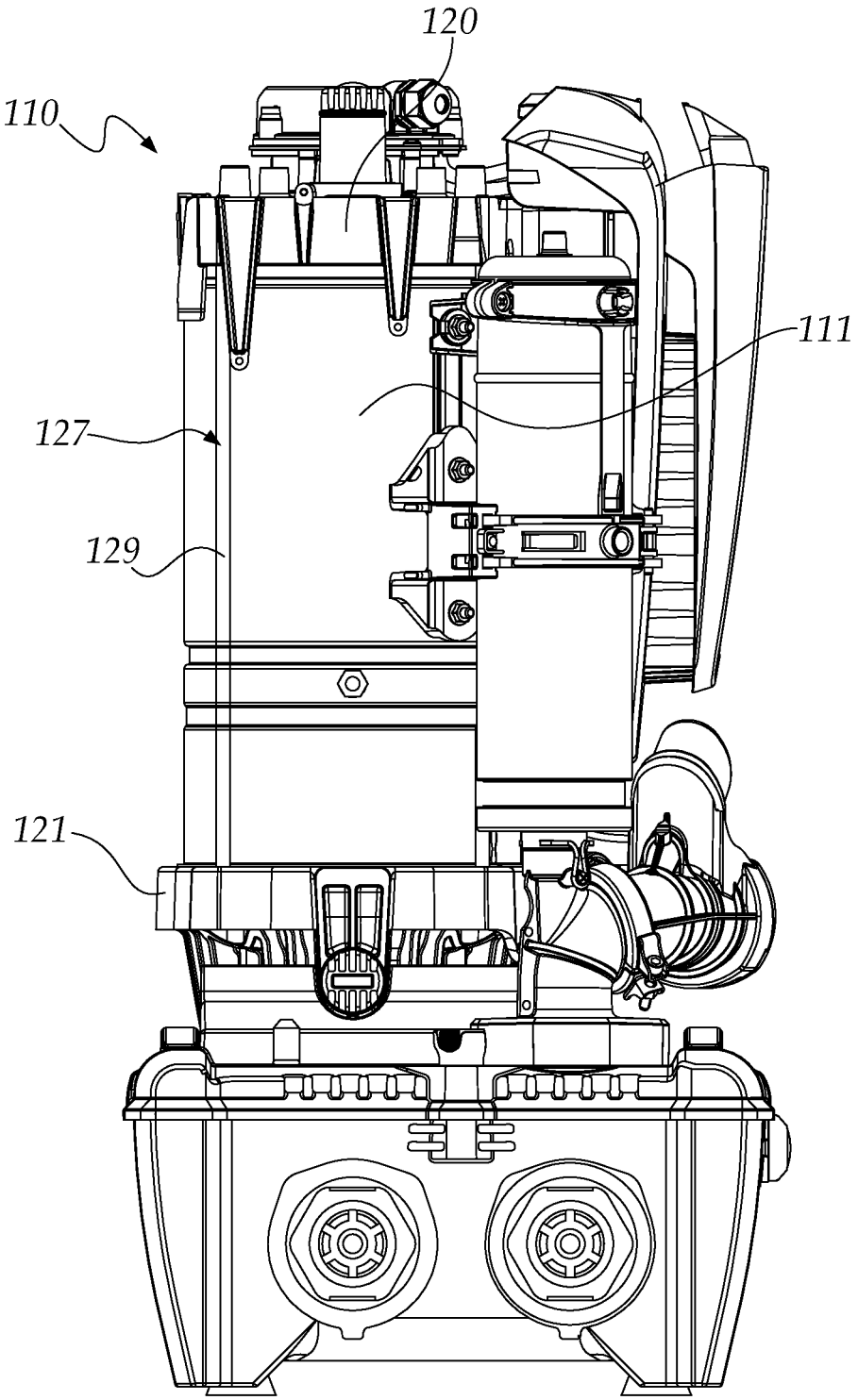
FIGS. 5*a* and 5*b* are each a perspective view of an electric pump according to the invention in a second embodiment.
Figure 5B:
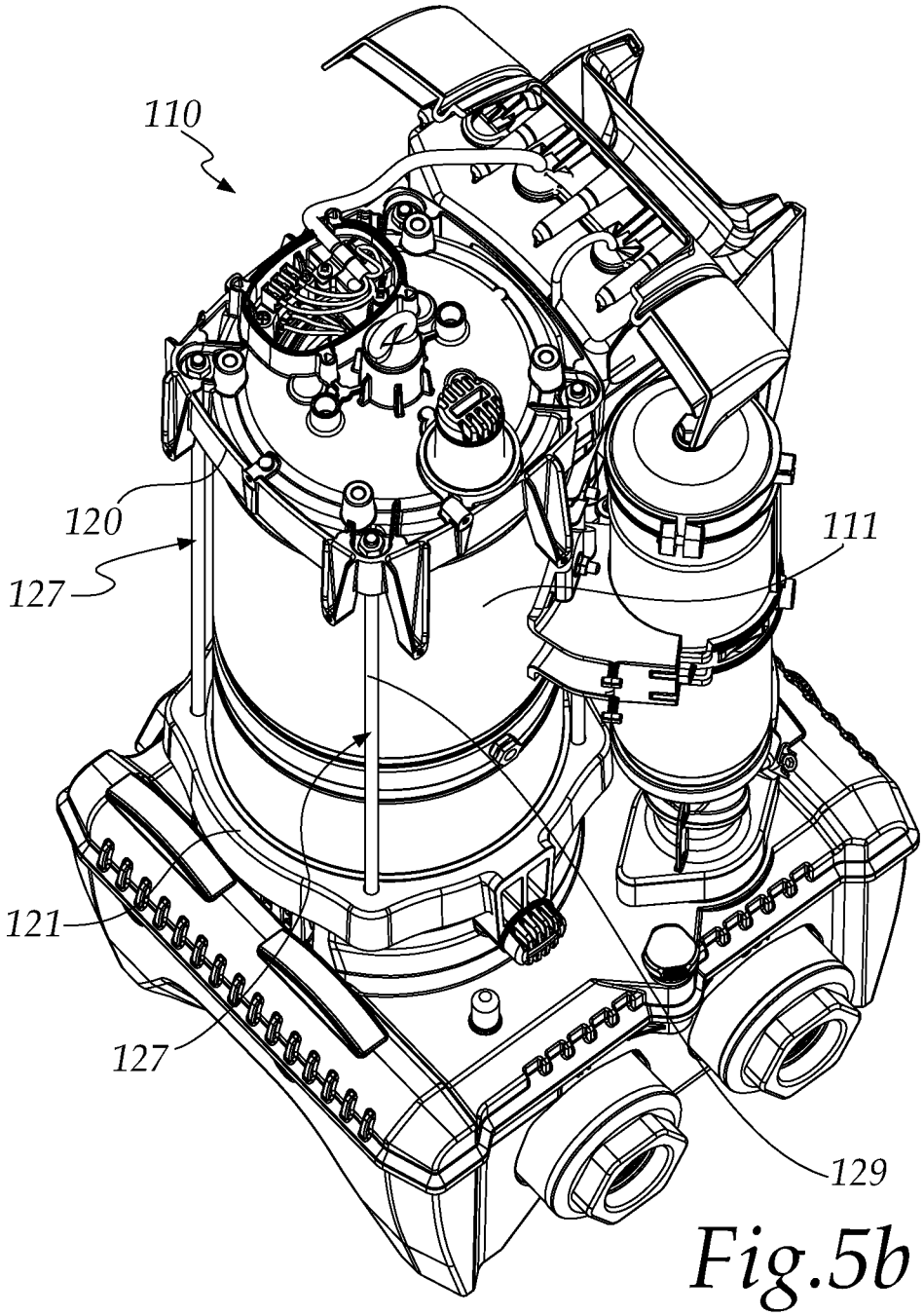
Figure 6:
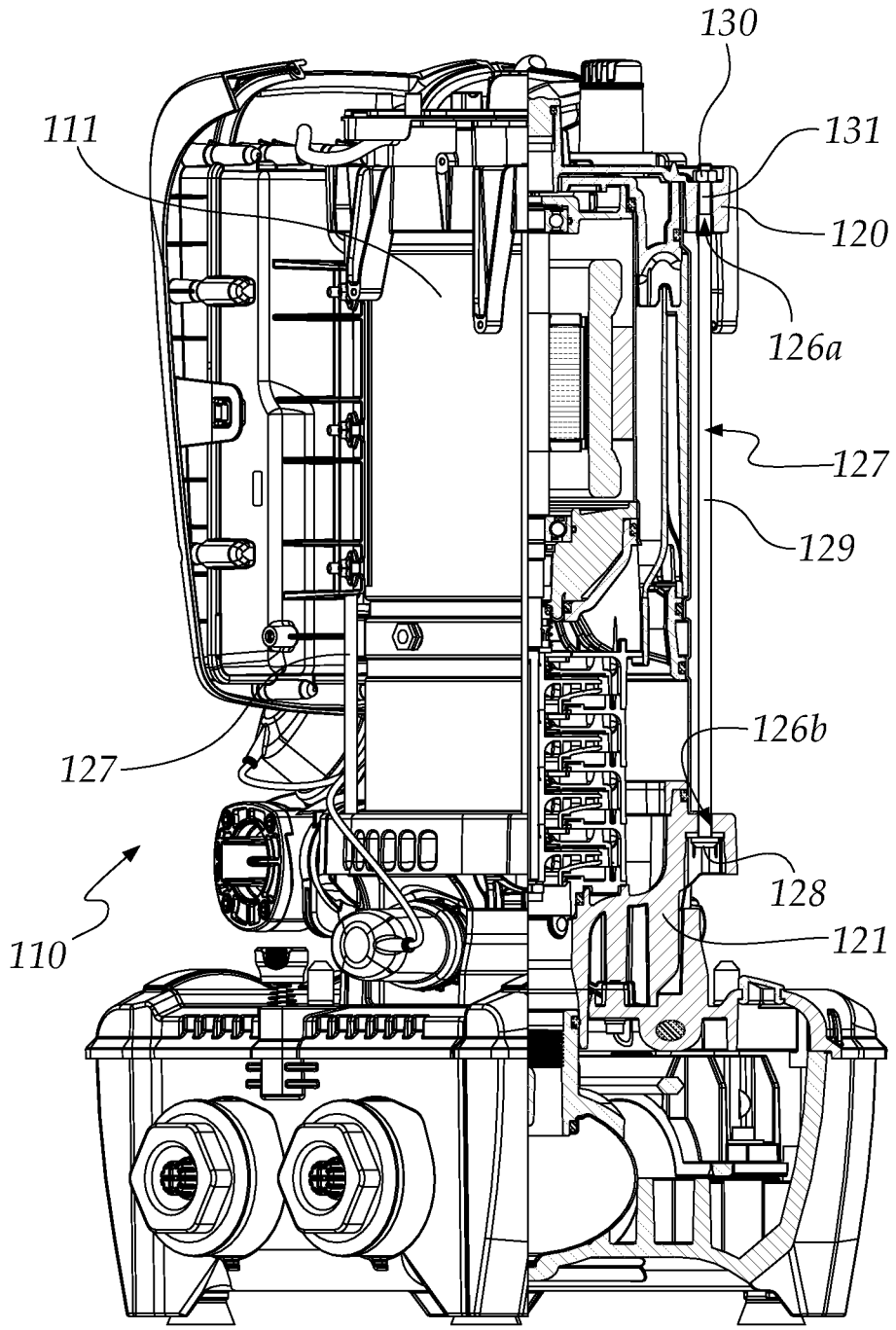
FIG. 6 is a partially sectional perspective view of the electric pump of FIGS. 5*a* and 5*b*.

In a further embodiment, shown in FIGS. 5*a*, 5*b* and 6, the electric pump according to the invention is generally designated by the reference numeral 110.

The electric pump 110 is similar to the electric pump described previously, but unlike it the jacket 111 is fixed simultaneously to the first cover 120 and to the second cover 121 by means of a plurality of tension members 127.

In particular, each one of these tension members 127 has a stein 129 that is comparable in length with the distance between the two covers, the first one 120 and the second one 121, considering a direction parallel to the axis of extension of the electric pump.

The first cover 120 is provided with a plurality of first holes 126*a*, which correspond to a plurality of second holes 126*b*, provided in the second cover 121, so as to form pairs of corresponding first holes 126*a* and second holes 126*b*.

Each tension member 127 crosses, with its stein 129, a respective pair of holes 126*a*-126*b* and has, for the fastening of the two covers 120 and 121 to the jacket 111:

at a first end, a wider head 128, proximate to/at the second hole 126*b*.

at a second threaded end 131, which is opposite the first end, a nut 130 which is screwed to it, proximate to/at the first hole 126*a*.

Due to the interference between the wider head 128 or the nut 130 and the rim of the corresponding hole 126*b* or 126*a*, a connection between the two covers 120 and 121 and the fixing thereof to the jacket 111 is produced.

In practice it has been found that the invention achieves the intended aim and objects, providing an electric pump with external containment jacket that has an easier and quicker process for the production thereof and of the entire electric pump than similar electric pumps of the known type.

The invention provides an electric pump which allows the fixing of the electronic board assembly and of the collar for the anchoring of the tank directly on the jacket without the use of additional components.

The invention provides an electric pump which has a jacket that allows to reduce the overall space occupations of the electric pump with respect to similar electric pumps of the known type.

Furthermore, the invention provides an electric pump which allows the draining of any liquid that might have seeped through the mechanical seal, at the interface between the mechanical section and the electromechanical section, allowing at the same time the installation technician/user to be aware of the tightness problem without requiring direct visual contact with the affected section.

The invention thus conceived is susceptible of numerous modifications and variations, all of which are within the scope of the appended claims; all the details may furthermore be replaced with other technically equivalent elements.

In practice, the materials used, so long as they are compatible with the specific use, as well as the contingent shapes and dimensions, may be any according to the requirements and the state of the art.

The disclosures in Italian Patent Application No. 102020000004882 from which this application claims priority are incorporated herein by reference. The jacket is provided monolithically.

What is claimed is:

1. An electric pump for moving a liquid, comprising a containment jacket which encloses:

a mechanical section, which comprises an assembly for moving said liquid which comprises one or more impellers, interleaved by diffusers, keyed on a driving shaft, an electromechanical section, comprising an electric motor, contained in a shell and comprising in turn a rotor and a stator that surrounds said rotor, said rotor being keyed on said driving shaft, said electric pump comprising, at ends of said containment jacket, a first cover and a second cover, said second cover having an intake port and a delivery port which are fluidically connected to said mechanical section, said electric pump being characterized in that said containment jacket is provided monolithically, wherein said electric pump further comprises an electronic assembly, which contains an electronic board for control of said motor which is fixed to an outer lateral surface of said containment jacket, and wherein the outer lateral surface of said containment jacket has:

a plurality of fixing elements for fixing it to said electronic assembly, and/or a plurality of fixing elements for fixing a collar for the anchoring of a tank of said electric pump.

2. The electric pump according to claim 1, wherein said containment jacket has a substantially tubular shape with a substantially cylindrical extension and an axis of extension thereof substantially coincides with an axis of extension of said electric pump.

3. The electric pump according to claim 2, wherein said containment jacket is provided with one or more through holes, an axis of extension of which is perpendicular to the axis of extension of said containment jacket, said one or more through holes being located at said electromechanical section, in a portion thereof, said portion being proximate to said mechanical section and being substantially comprised between said shell for containing of said motor and an interface between said mechanical section and said electromechanical section.

4. The electric pump according to claim 3, wherein a nipple is inserted in each one of said one or more through holes.

5. The electric pump according to claim 3, further comprising at least one nipple which is fluidically connected to said portion of said electromechanical section.

6. The electric pump according to claim 5, further comprising a drainage tray which is connected to said at least one nipple that is connected fluidically to said portion of said electromechanical section.

7. The electric pump according to claim 3, further comprising a wet portion inside said electromechanical section, which is separated from said portion of said electromechanical section and surrounds said shell, said wet portion being shaped so as to allow a passage of said liquid between said intake port and said delivery port, said liquid skimming:

the outer lateral surface of said shell, moving from said intake port toward said first cover, the inner lateral surface of said containment jacket, moving from said first cover toward said delivery port.

8. The electric pump according to claim 1, wherein said jacket is made of a metallic material by calendering and welding.

9. The electric pump according to claim 1, wherein said containment jacket has a plurality of slots in which elements for fixing said jacket to said first cover and to said second cover are inserted, said slots:

being provided with a hole, an axis of extension of which is substantially parallel to the axis of extension of said containment jacket, being arranged on an outer lateral surface of said containment jacket, proximate to a respective cover.

10. The electric pump according to claim 1, wherein said fixing elements are threaded stems which are fixed to said containment jacket, with an axis of extension that is perpendicular to the axis of extension of said containment jacket.

11. The electric pump according to claim 1, wherein said electronic assembly comprises a heat sink which faces on one side said electronic board and on another side said containment jacket.

12. The electric pump according to claim 1, wherein said containment jacket is provided with one or more fixing elements for the fixing/support/thermal contact of said electronic assembly with respect to said containment jacket.

13. The electric pump according to claim 12, wherein said fixing/support/thermal contact elements are pins with an internal dead hole the axis of extension of which coincides with the axis of extension of the respective one of said pins, said pins being welded to said jacket with their axis of extension at right angles to the axis of extension of said containment jacket, said pins being inserted in corresponding through holes of said heat sink and being fastened to it by means of respective screws, each one of said screws being inserted in said internal dead hole of said pins.

14. The electric pump according to claim 1, wherein said containment jacket has such a shape as to provide a mechanical seal with a plurality of corresponding sealing elements arranged along the axis of extension of said electric pump, inside said containment jacket at different cross-sections of the latter.

15. The electric pump according to claim 1, wherein said containment jacket is fixed simultaneously to said first cover and to said second cover by means of a plurality of tension members.

16. The electric pump according to claim 15, wherein each one of said tension members has a stem that is comparable in length with the distance between said first cover and said second cover.

17. The electric pump according to claim 1, wherein said first cover is provided with a plurality of first holes which correspond to a plurality of second holes provided in said second cover so as to form pairs of matching first holes and second holes, a plurality of tension members crossing, with a stem, a respective pair of holes and having:

at a first end, a wider head, at a second threaded end, which is opposite the first end, a nut which is screwed to it.

* * * * *